US010953674B2

(12) United States Patent
Kanda et al.

(10) Patent No.: US 10,953,674 B2
(45) Date of Patent: Mar. 23, 2021

(54) PRINTER AND RECORDING MEDIUM

(71) Applicant: Brother Kogyo Kabushiki Kaisha, Nagoya (JP)

(72) Inventors: Mitsuhiro Kanda, Nagoya (JP); Masaru Uno, Toyokawa (JP); Yuji Iida, Chita (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 16/235,322

(22) Filed: Dec. 28, 2018

(65) Prior Publication Data

US 2019/0217638 A1 Jul. 18, 2019

(30) Foreign Application Priority Data

Jan. 12, 2018 (JP) ..... JP2018-003425

(51) Int. Cl.
*B41J 13/03* (2006.01)
*B41J 3/407* (2006.01)
(Continued)

(52) U.S. Cl.
CPC ..... *B41J 13/03* (2013.01); *B41J 3/4075* (2013.01); *B41J 11/009* (2013.01);
(Continued)

(58) Field of Classification Search
CPC .... B41J 3/4075; B41J 11/009; B41J 11/0095; B41J 11/663; B41J 13/0027; B41J 15/042; B41J 13/03
See application file for complete search history.

(56) References Cited

U.S. PATENT DOCUMENTS 9,162,481 B2 10/2015 Moriyama et al.
9,656,486 B2 5/2017 Kanda
(Continued)

FOREIGN PATENT DOCUMENTS

JP 2005-047087 A 2/2005
JP 2006-079514 A 3/2006
(Continued)

OTHER PUBLICATIONS

Jan. 29, 2021—(JP) Notice of Reasons for Refusal—App 2018-003425.

*Primary Examiner* — Lamson D Nguyen
(74) *Attorney, Agent, or Firm* — Banner & Witcoff, Ltd.

(57) ABSTRACT

The disclosure discloses a printer including a feeder configured to feed one print-receiving medium that comprises a plurality of print-receiving parts. A printing head is configured to form a plurality of print parts by sequentially forming desired prints on the plurality of print-receiving parts. A CPU executes a determination process and a printing control process. In the determination process, a type of the one print-receiving medium is determined on the basis of a comparison between the parameters of the one print-receiving medium detected by a sensor and the parameters of each of the plural types of print-receiving medium stored in a memory. In the printing control process, controlling a print formation operation of the printing head is controlled on the basis of a determination result in the determination process.

11 Claims, 12 Drawing Sheets

(51) Int. Cl.

| | |
|---|---|
| ***B41J 11/00*** | (2006.01) |
| ***B41J 29/38*** | (2006.01) |
| ***B41J 13/00*** | (2006.01) |
| ***B41J 15/04*** | (2006.01) |
| ***B41J 21/17*** | (2006.01) |
| ***B41J 11/66*** | (2006.01) |

(52) U.S. Cl.
CPC ..... *B41J 11/0095* (2013.01); *B41J 11/663* (2013.01); *B41J 13/0027* (2013.01); *B41J 15/042* (2013.01); *B41J 21/17* (2013.01); *B41J 29/38* (2013.01)

(56) References Cited

U.S. PATENT DOCUMENTS

| | | | | |
|---|---|---|---|---|
| 2014/0152753 | A1 | 6/2014 | Moriyama et al. | |
| 2017/0028747 | A1 | 2/2017 | Kanda | |
| 2018/0063347 | A1* | 3/2018 | Conlon ..... | H04N 1/00708 |

FOREIGN PATENT DOCUMENTS

| | | | |
|---|---|---|---|
| JP | 2014-108590 | A | 6/2014 |
| JP | 2016-011997 | A | 1/2016 |
| JP | 2017-030249 | A | 2/2017 |

* cited by examiner

[FIG. 1]
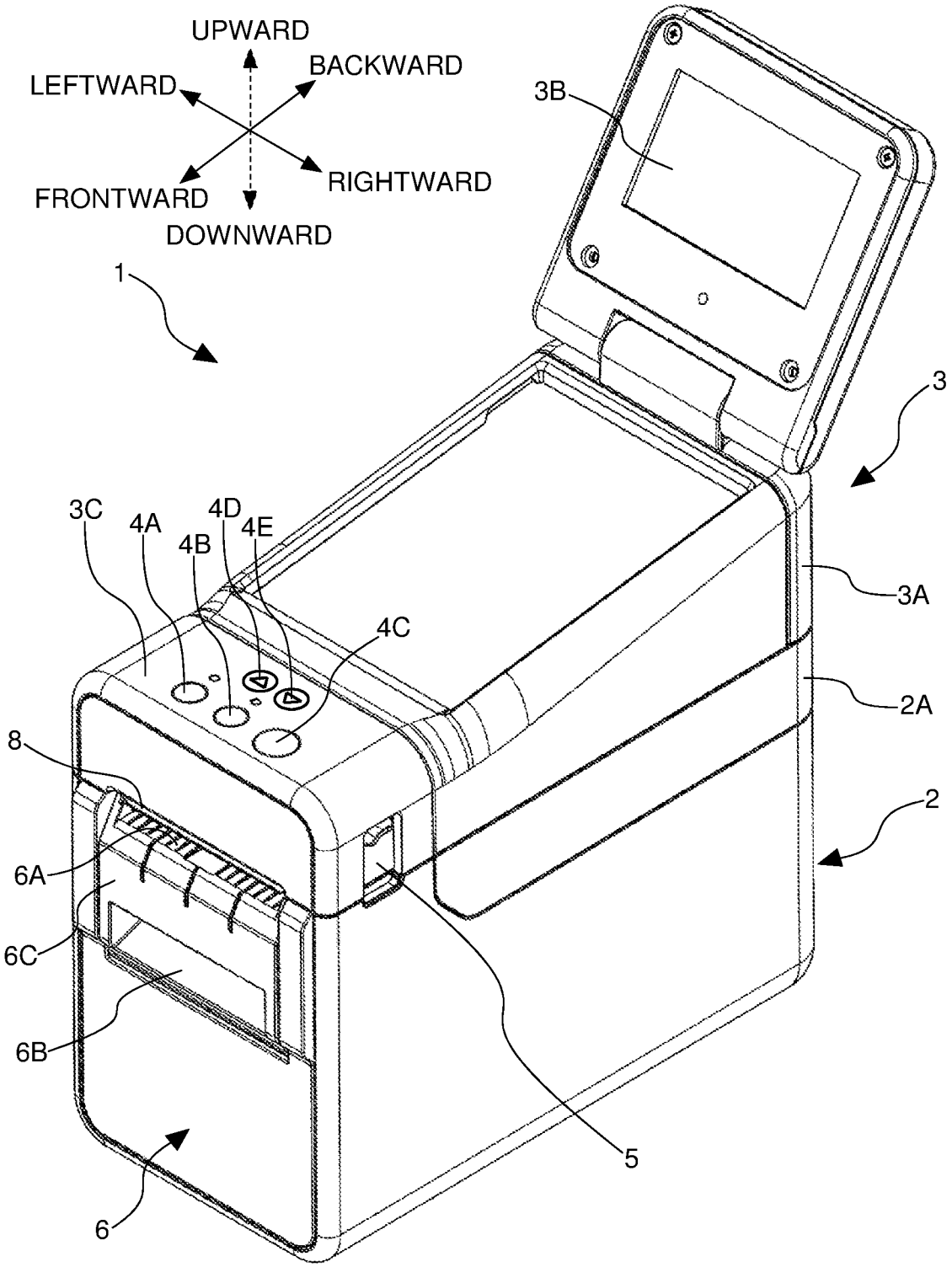

[FIG. 2]
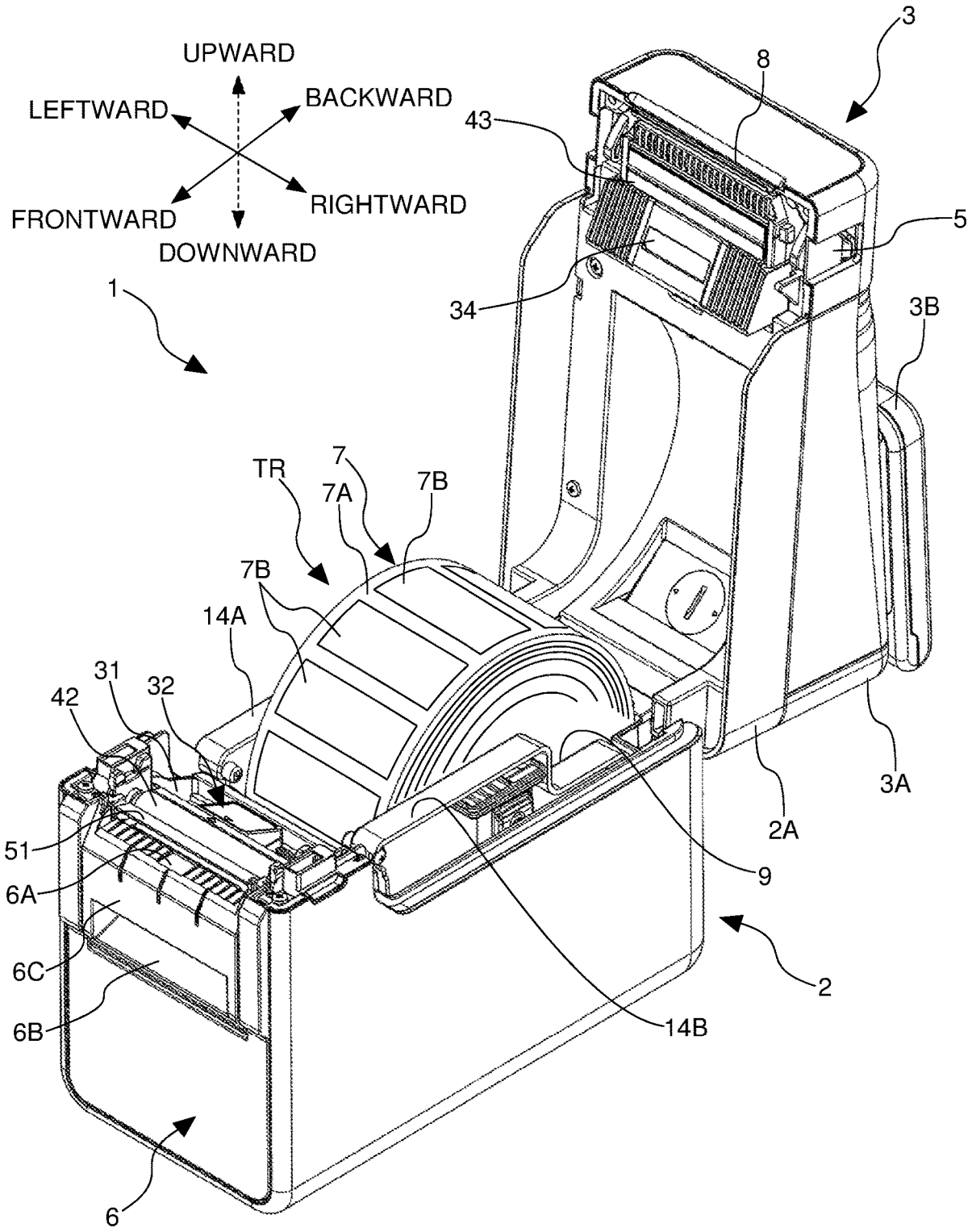

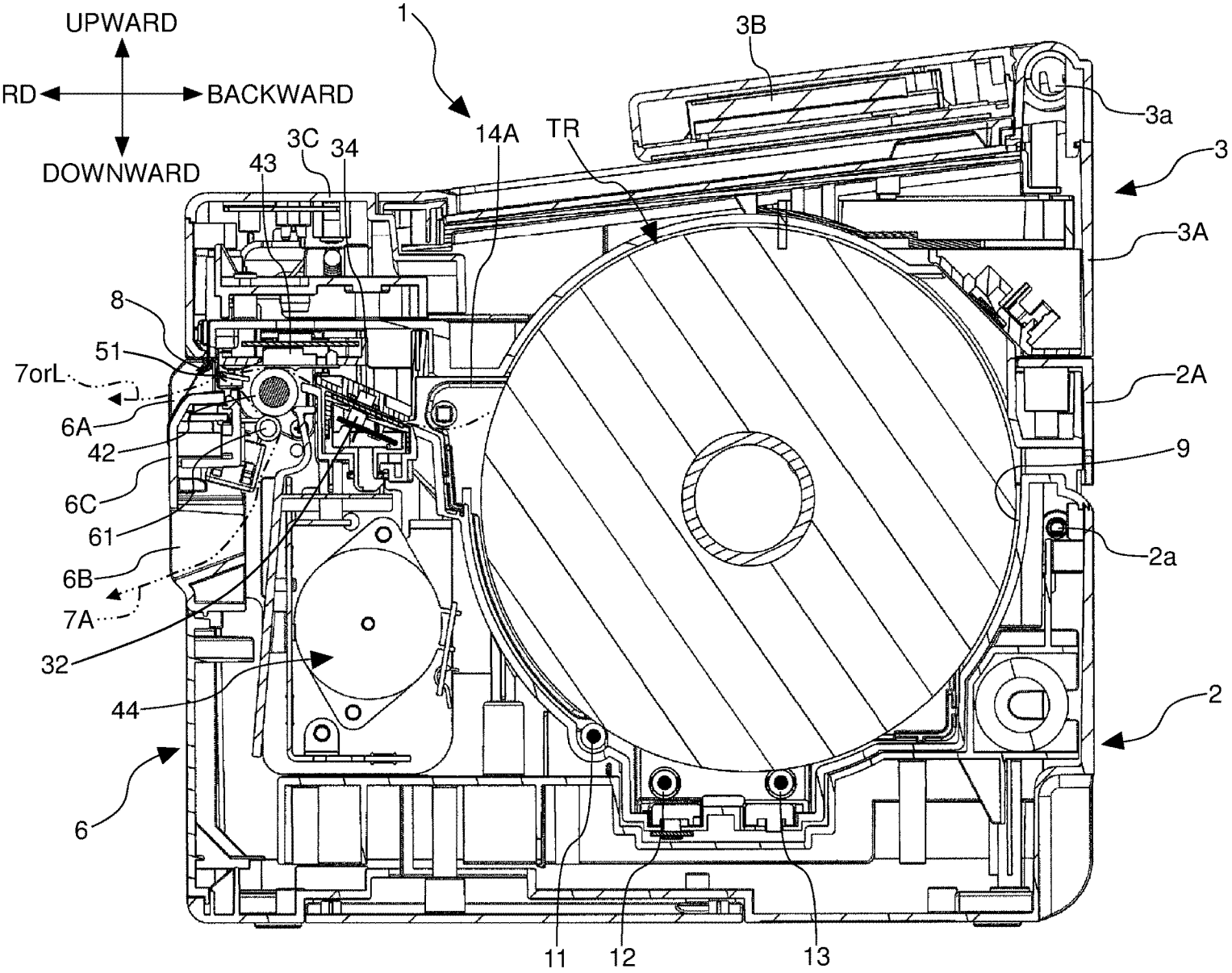
[FIG. 3]

[FIG.4]
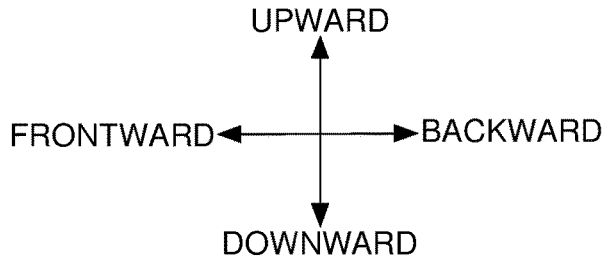
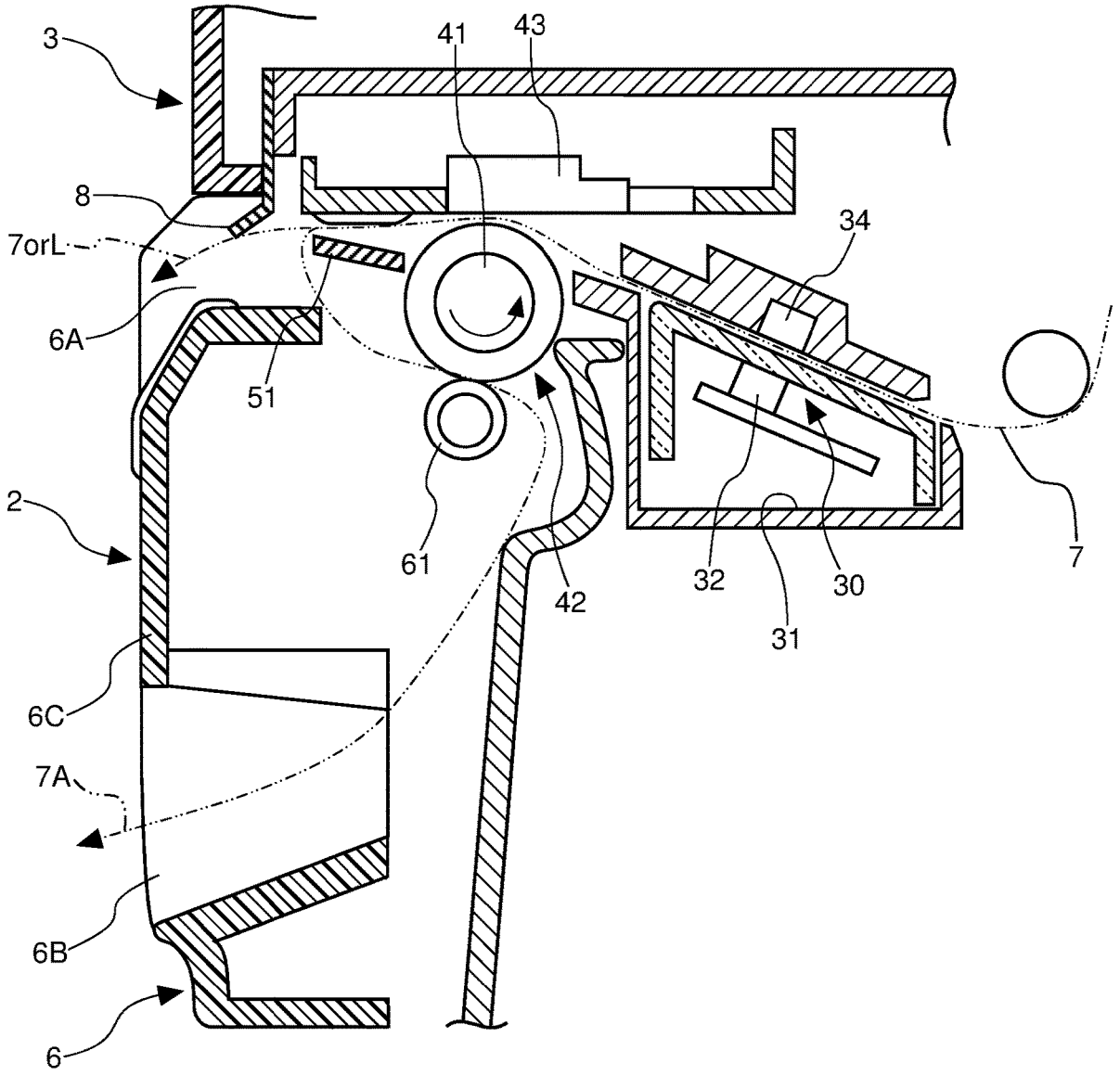

[FIG.5A]
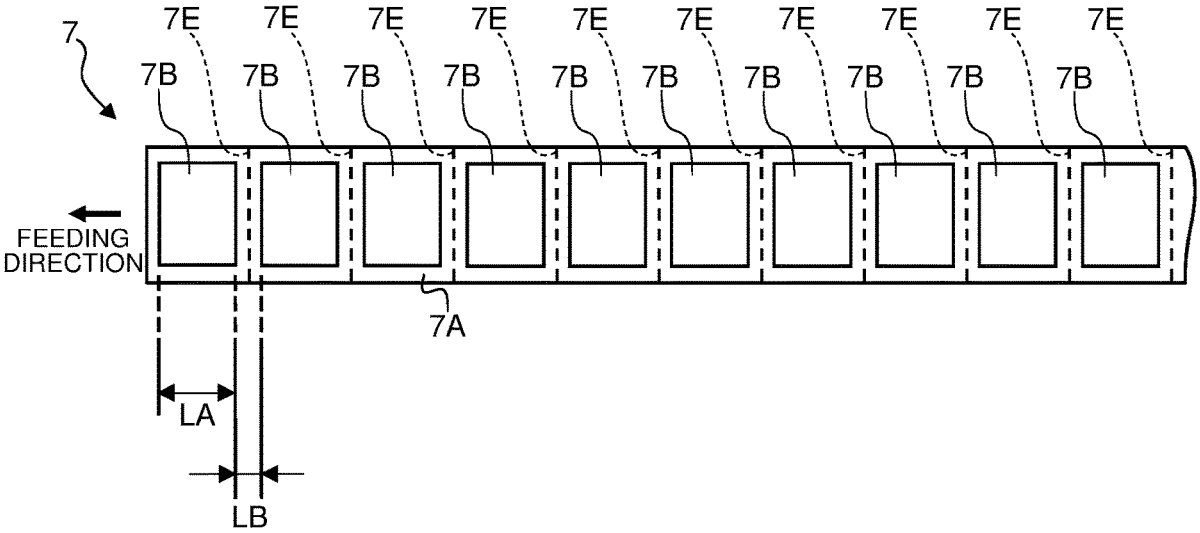
[FIG.5B]
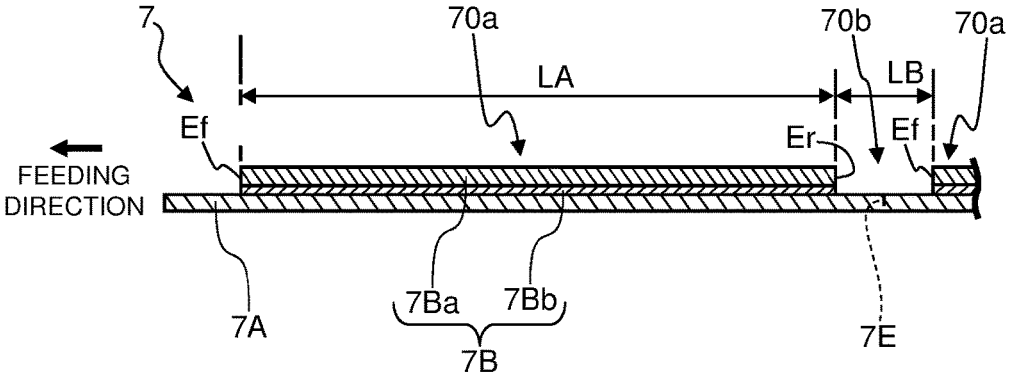

[FIG. 6]
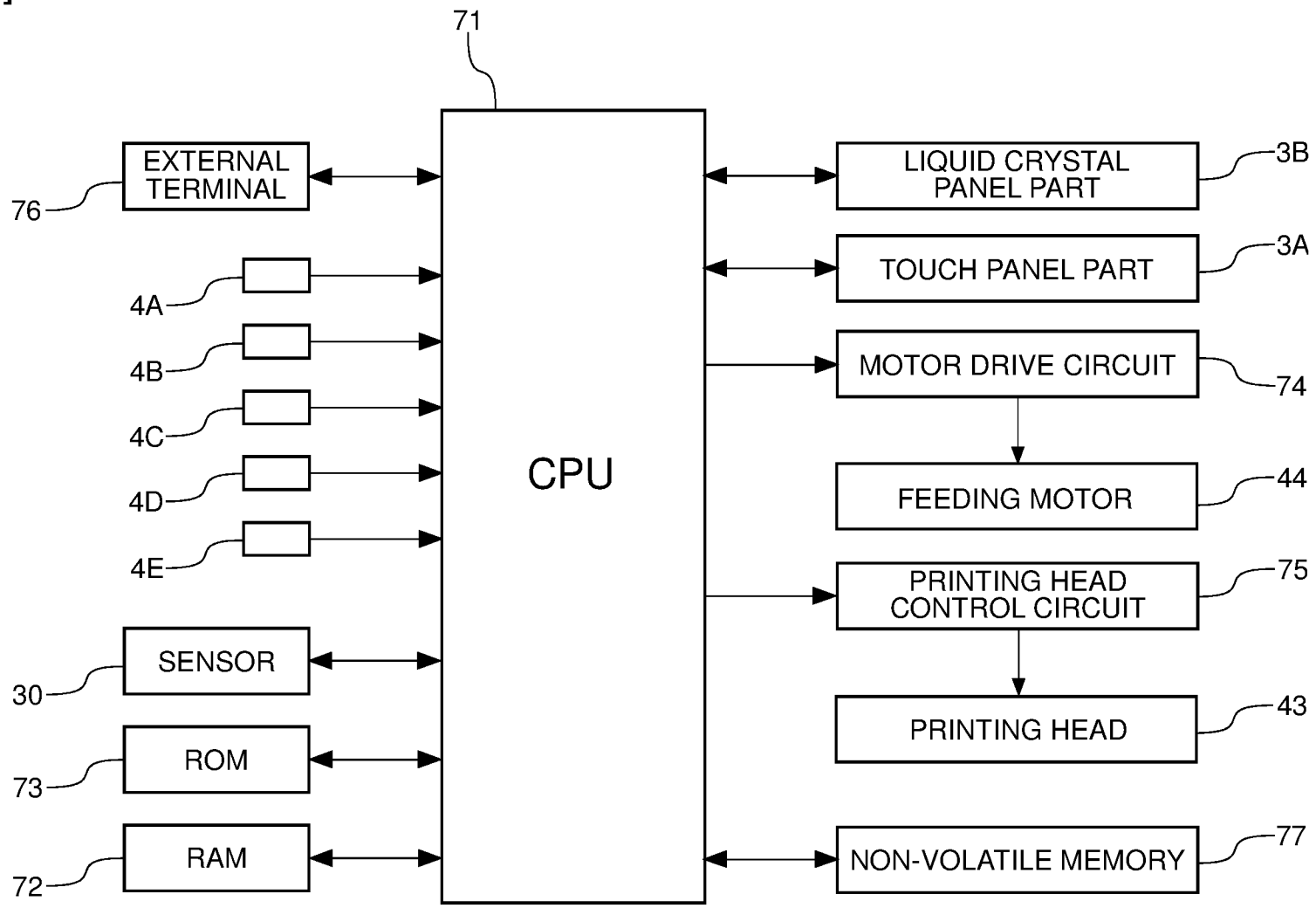

[FIG. 7A]
NORMAL PRINT
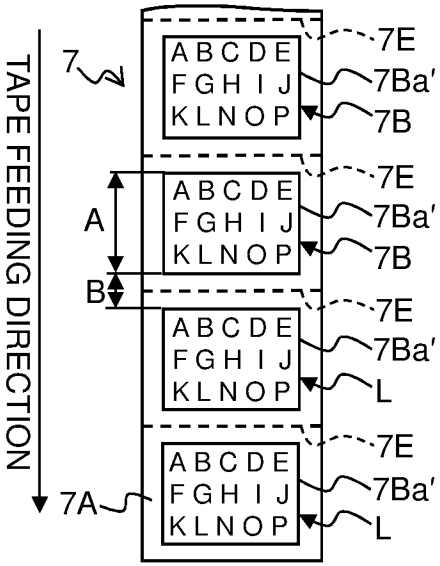
[FIG. 7B]
OCCURRENCE OF CUT-OFF CHARACTER
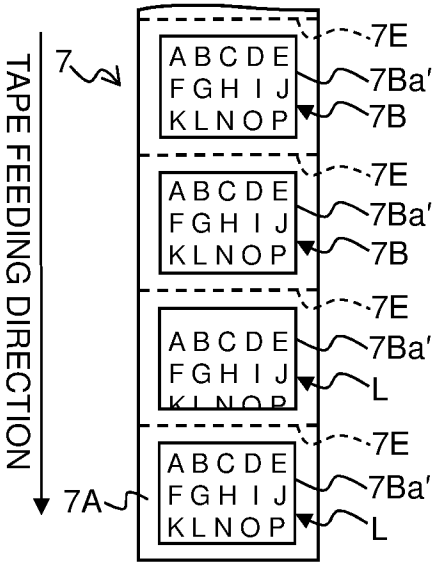
[FIG. 7C]
OCCURRENCE OF MISTAKEN PAGE FEEDING
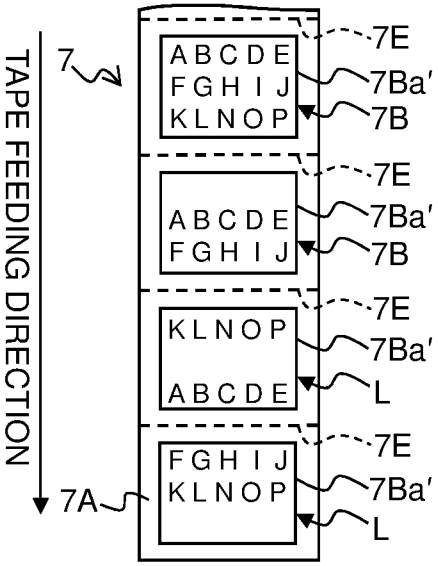

[FIG. 8A]

| MEDIUM TYPE | WIDTH | SHEET LENGTH LA | GAP LENGTH LB | MEDIUM LENGTH L (=LA+LB) |
|---|---|---|---|---|
| A | 50.0 | 85.0 | 3.0 | 88.0 |
| B | 60.0 | 92.0 | 3.2 | 95.2 |
| C | 80.0 | 115.0 | 3.5 | 118.5 |
| D | 102.0 | 50.0 | 2.8 | 52.8 |
| E | 102.0 | 84.0 | 2.95 | 86.95 |
| F | 102.0 | 102.0 | 3.1 | 105.1 |
| G | 102.0 | 152.0 | 3.35 | 155.35 |
| . . | . . | . . | . . | . . |

[FIG. 8B]

| DETECTION NUMBER | SHEET LENGTH ACTUAL MEASURE LAr | GAP LENGTH ACTUAL MEASURE LBr | MEDIUM LENGTH Lr (=LAr+LBr) | DETERMINED MEDIUM TYPE |
|---|---|---|---|---|
| 1 | 84.7 | 3.20 | 87.9 | A |
| 2 | 85.4 | 2.95 | 88.35 | A |
| 3 | 84.4 | 3.20 | 87.6 | A |
| 4 | 114.7 | 3.60 | 118.3 | C |
| 5 | 116.0 | 3.45 | 119.45 | C |
| 6 | 115.5 | 3.55 | 119.05 | C |
| . . | . . | . . | . . | . . |
| . . | . . | . . | . . | . . |

[FIG.9]
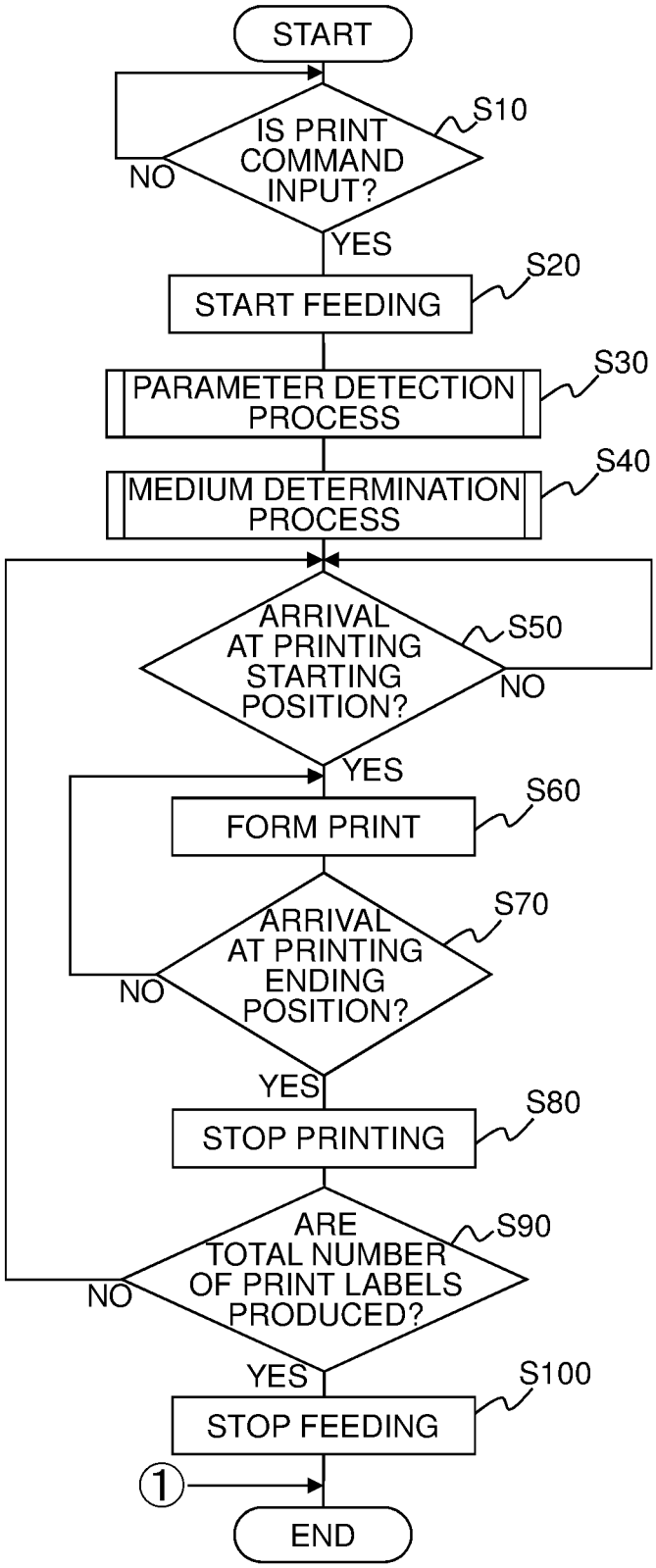

[FIG.10]
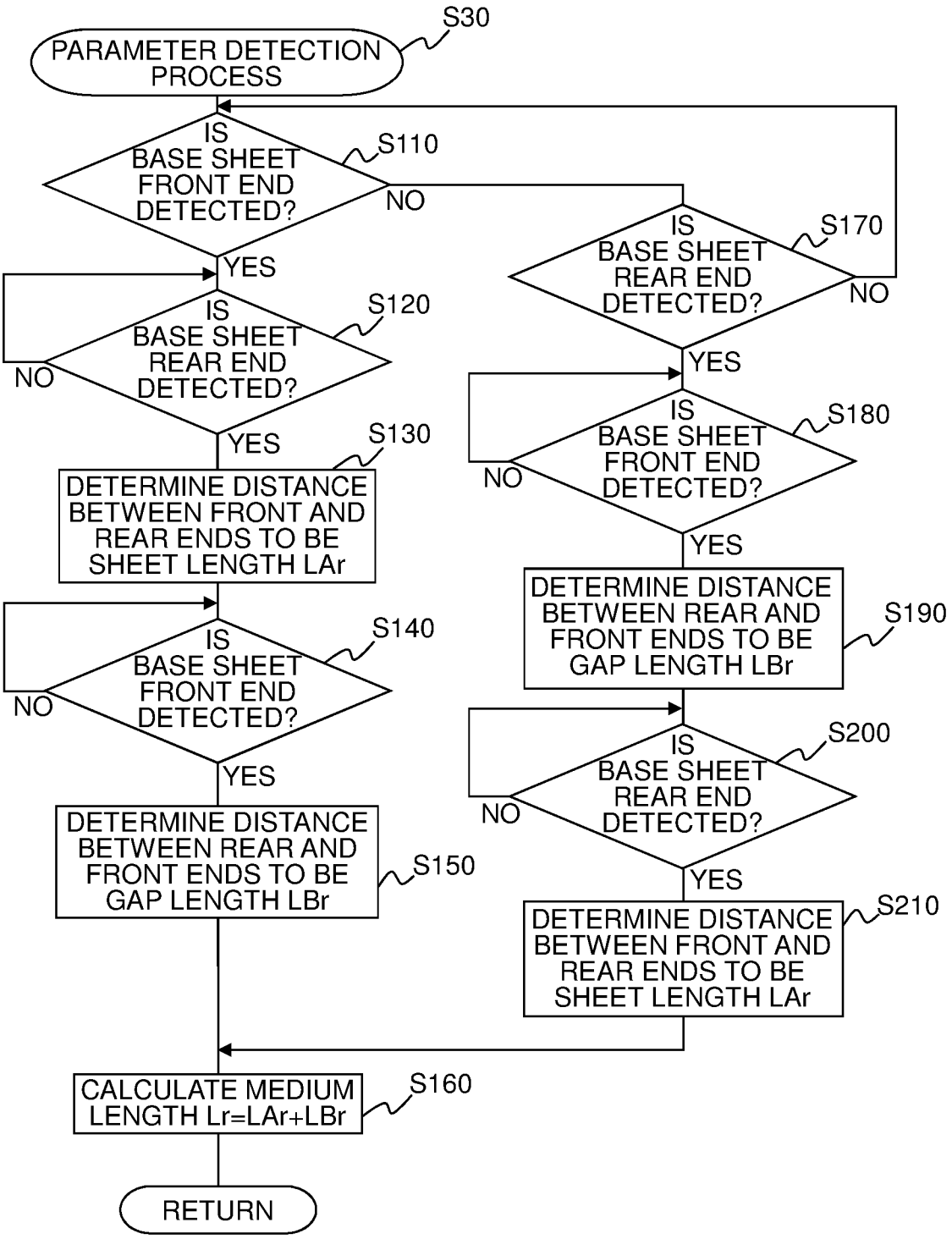

[FIG.11]
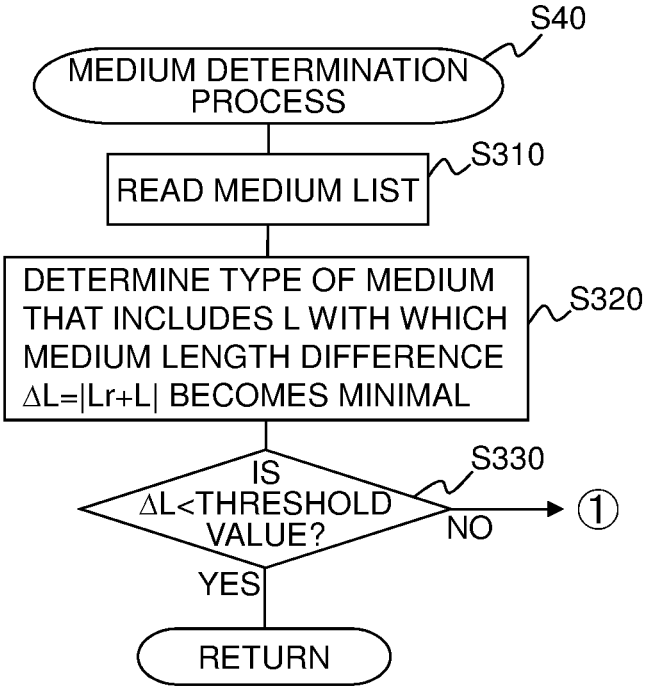

[FIG.12]
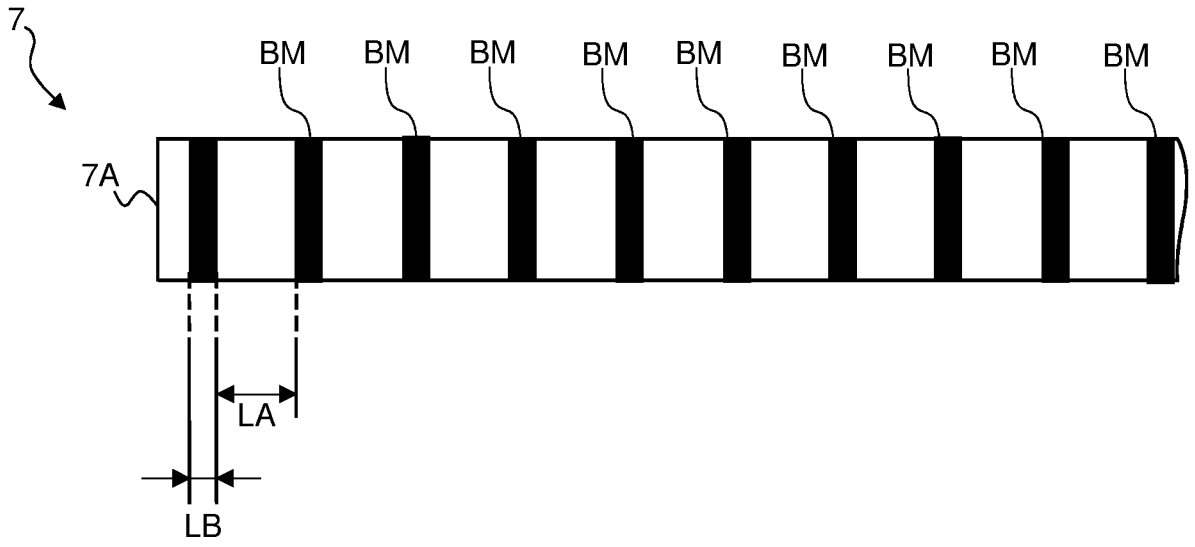

PRINTER AND RECORDING MEDIUM

CROSS-REFERENCE TO RELATED APPLICATION

The present application claims priority from Japanese Patent Application No. 2018-003425, which was filed on Jan. 12, 2018, the disclosure of which is incorporated herein by reference in its entirety.

BACKGROUND

Field

The present disclosure relates to a printer that sequentially forms desired prints on a print-receiving medium and a recording medium that stores therein a printing process program executed by the printer.

Description of the Related Art

A printer that sequentially forms desired prints on a print-receiving medium is known. With this prior art, when the print-receiving medium (a print-receiving tape) is attached to the printer (a label producing apparatus) and is fed, desired prints are sequentially formed by a printing head, in plural print-receiving portions included in the fed print-receiving medium to form plural print parts.

At this time, this printer can perform the printing selectively using proper one of plural types of print-receiving medium. A sensor is therefore disposed to detect which type of print-receiving medium the one attached to the printer is, and, when the print-receiving medium is fed, this sensor detects parameters of the fed print-receiving medium (such as the length of a label base sheet portion and the length of a gap as a portion between the label base sheets). A print formation operation performed by the printing head is controlled corresponding to the result of the detection.

In the case that, as above, the printing is controlled on the basis of the result of the detection by the sensor performed when the feeding is performed, the detected values of the parameters are fluctuated due to a detection error of the sensor, disorder of the print-receiving medium during its feeding, fluctuation of the mechanical resistance in the printer, and the like and, as a result, the mode of the control of the print formation operation may be changed even with the same type of print-receiving medium. In this case, it is difficult to prevent any degradation and any dispersion of the print quality.

SUMMARY

An object of the present disclosure is to provide a printer and a recording medium that can prevent any degradation and any dispersion of the print quality even when it is assumed that the values of the detected parameters are somewhat fluctuated.

In order to achieve the above-described object, according to aspect of the present application, there is provided a printer comprising a feeder configured to feed one print-receiving medium that comprises a plurality of print-receiving parts, a printing head configured to form a plurality of print parts by sequentially forming desired prints on the plurality of print-receiving parts of the one print-receiving medium fed by the feeder, a memory that stores in advance parameters in relation to an outer shape of each of plural types of the print-receiving medium, a sensor configured to detect the parameters of the one print-receiving medium fed by the feeder during the feeding, and a CPU, the CPU executing a determination process for determining a type of the one print-receiving medium on the basis of a comparison between the parameters of the one print-receiving medium detected by the sensor and the parameters of each of the plural types of print-receiving medium stored in the memory, and a printing control process for controlling a print formation operation of the printing head on the print-receiving medium fed by the feeder on the basis of a determination result in the determination process.

BRIEF DESCRIPTION OF THE DRAWINGS

FIG. 1 is a perspective view showing an outer appearance of a label producing apparatus in relation to an embodiment of the present disclosure.

FIG. 2 is a perspective view showing the state of the label producing apparatus where a top cover unit thereof is opened.

FIG. 3 is a side cross-sectional view showing the overall structure of the label producing apparatus.

FIG. 4 is a side cross-sectional view showing the structure of the essential portion of the label producing apparatus.

FIG. 5A is a top view of a print-receiving tape.

FIG. 5B is a side cross-sectional view of the print-receiving tape.

FIG. 6 is a block view showing a control system of the label producing apparatus.

FIG. 7A is an explanatory view for explaining the fact that a control mode of the print formation operation is changed due to fluctuation of detected values of parameters.

FIG. 7B is an explanatory view for explaining the fact that the control mode of the print formation operation is changed due to the fluctuation of the detected values of the parameters.

FIG. 7C is an explanatory view for explaining the fact that the control mode of the print formation operation is changed due to the fluctuation of the detected values of the parameters.

FIG. 8A is a medium list that stores therein the parameters relating to the outer shape of each of plural types of print-receiving tape.

FIG. 8B is an explanatory view for explaining an approach of determining the type of the print-receiving tape on the basis of the parameters that are actually detected when the print-receiving tape is fed.

FIG. 9 is a flowchart showing control steps performed by a CPU of the label producing apparatus.

FIG. 10 is a flowchart showing detailed steps of step S30.

FIG. 11 is a flowchart showing detailed steps of step S40.

FIG. 12 is a back face view showing a modification example where black marks are disposed on a back face of a separation material.

DETAILED DESCRIPTION OF THE PREFERRED EMBODIMENT

An embodiment of the present disclosure will be described below with reference to the drawings.

<Schematic Configuration of Outer Appearance>

The schematic configuration of the outer appearance of a label producing apparatus of this embodiment will be described with reference to FIG. 1. In the following description, "frontward", "backward", "leftward", "rightward", "upward", and "downward" show the directions of arrows properly shown in FIG. 1 and the like.

As shown in FIG. 1, a label producing apparatus 1 (that corresponds to a printer) includes a housing 2 including a front panel 6, and a top cover unit 3. The housing 2 and the top cover unit 3 are each made from, for example, a resin. The top cover unit 3 includes a touch panel part 3A, a liquid crystal panel part 3B having a substantially rectangular shape, and an operation button part 3C.

The top cover unit 3 is rotatably connected to the housing 2 in the backward end portion of the housing 2 through a rotation shaft part 2*a* (see FIG. 3 described later) and, as a result, the top cover unit 3 has a structure to be able to be opened or closed from/to the housing 2. In the lower portion of the top cover unit 3, a housing cover part 2A constituting a portion of the housing 2 is integrally included therein and, when the top cover unit 3 is opened or closed, the housing cover part 2A is opened or closed integrally therewith (see FIG. 2 described later).

The liquid crystal panel part 3B is rotatably connected to the touch panel part 3A in the backward end portion through a rotation shaft part 3*a* (see FIG. 3 described later) and, as a result, the liquid crystal panel part 3B has a structure to be able to be opened or closed from/to the touch panel part 3A.

The operation button part 3C is disposed at a somewhat frontward position on an upper face of the top cover unit 3 and has a power source button 4A of the label producing apparatus 1, a status button 4B to display the operation state of a peripheral device, a feed button 4C, an up button 4D, a down button 4E, and the like arranged therein.

A release tab 5 is disposed on each of both of side walls on the right and the left of the housing 2 (in FIG. 1, only the release tab 5 disposed on the right side wall is shown). The engagement of the top cover unit 3 with the housing 2 is released to establish the state where the top cover unit 3 can be opened, by pushing these releasing tabs 5 upward.

The front panel 6 has a first discharging exit 6A and a second discharging exit 6B positioned at a region on the side lower than the first discharging exit 6A disposed thereon. A portion including the second discharging exit 6B, of the front panel 6 acts as an opening and closing lid 6C that is pivotally movable to the front side to facilitate the convenience of, for example, placement and discharging of a print-receiving tape 7 described later.

In the state where the top cover unit 3 is closed, the first discharging exit 6A is formed by an upper edge portion on the front face side of the housing 2 and a lower edge portion on the front face side of the top cover unit 3. A cutting blade 8 is disposed facing downward on the inner side of a lower edge portion on the side of the first discharging exit 6A of the top cover unit 3 (see also FIG. 2 to FIG. 4 described later).

<Internal Structure>

The internal structure of the label producing apparatus 1 will be described next with reference to FIG. 2 to FIG. 4.

As shown in FIG. 2 to FIG. 4, the label producing apparatus 1 includes a roll storage part 9 having a concave shape behind the internal space of the housing 2. The roll storage part 9 stores therein a roll TR having the print-receiving tape 7 having a desired width (that corresponds to a print-receiving medium) wound therein in a roll for the print-receiving tape 7 to be fed out from the upper side of the roll.

The roll TR is rotatably stored in the roll storage part 9 in the state where the axis of the winding of the print-receiving tape 7 is in the right-and-left direction that is perpendicular to the front-and-rear direction.

<Print-Receiving Tape>

As shown in FIG. 2 and FIGS. 5A-5B, on the print-receiving tape 7 constituting the roll TR, label base sheets 7B each used for, for example, a price tag are consecutively arranged discretely along a longitudinal direction (that is, in other words, the feeding direction) on a separation material 7A. The label base sheet 7B has a two-layer structure in this example, and includes a print-receiving part 7Ba (a base material part of the label base sheet 7B) on which a print is formed by a printing head 43 described later and an adhesive 7Bb that are stacked on each other in this order. The label base sheets 7B are bonded to a face on one side of the separation material 7A at predetermined intervals by an adhering force of the adhesive 7Bb. In each of the portions each having the label base sheet 7B bonded thereto (hereinafter, referred to as "label base sheet portion" as necessary) 70*a*, the print-receiving tape 7 has a three-layer structure including the print-receiving part 7Ba, the adhesive 7Bb and the separation material 7A, and, in the portion not having the label base sheet 7B bonded thereto (that is, the portion between the adjacent label base sheets 7B and, hereinafter, referred to as "inter-label base sheet portion" as necessary) 70*b*, the print-receiving tape 7 has a one-layer structure including only the separation material 7A. The label base sheet 7B already after its printing is finally affixed to an affixation target such as a desired article as a print label L (see FIGS. 7A-7B and the like described later) by peeling off the separation material 7A. A perforation 7E may be disposed at the central position of each of the inter-label base sheet portions 70*b* of the separation material 7A.

<Support Rollers>

As shown in FIG. 2 to FIG. 4, three support rollers 11-13 are disposed on the bottom face portion of the roll storage part 9. As to the support rollers 11-13, when the platen roller 42 described later is driven to be rotated to pull out the print-receiving tape 7 from the roll TR, at least two rollers thereof are brought into contact with the outer circumference face of the roll TR and are rotated driven thereby to support the roll TR to be rotatable. The positions of these support rollers 11 to 13 in the circumference direction relative to the roll TR differ from each other, and the first support roller 11, the second support roller 12, and the third support roller 13 are arranged in this order along the circumference direction of the roll TR from the front to the back. The support rollers 11-13 are each divided into plural portions in the right-and-left direction (that is, in other words, the roll width direction), and only the portions having the roll TR mounted thereon are rotated in accordance with the roll width.

<Guide Member>

A first guide member 14A that is in contact with an end face on the right side of the roll TR and that guides the print-receiving tape 7 in the right-and-left direction (that is, the tape width direction), and a second guide member 14B that is in contact with an end face on the left side of the roll TR and that guides the print-receiving tape 7 in the right-and-left direction are disposed on the roll storage part 9. These guide members 14A-14B can be set to be close to or distant from each other by moving forward or backward along the right-and-left direction. The first guide member 14A is brought into contact with the roll TR from the right side and the second guide member 14B is brought into contact with the roll TR from the left side, and the first and the second guide members 14A-14B thereby sandwiches the roll TR therebetween from both sides to guide the print-receiving tape 7. Because the guide members 14A-14B are disposed to be able to move forward and backward along the right-and-left direction as above, the guide members 14A-

14B can sandwich the roll TR that has an optional width and can guide the print-receiving tape 7 in the width direction thereof for the roll TR, by adjusting the positions of the guide members 14A-14B by moving the guide members 14A-14B forward or backward in accordance with the width of the stored roll TR.

<Platen Roller, Printing Head, and Structure Around These>

The printing head 43 is disposed on the lower side of the front end portion of the top cover unit 3. A platen roller 42 (that corresponds to a feeder) is disposed on the upper side of the front end portion of the housing 2 to face the printing head 43 in the up-and-down direction. A roller shaft 41 of the platen roller 42 is journaled to freely rotate by brackets disposed at both ends in the shaft direction, and a gear not shown that drives the platen roller 42 is fixed at one shaft end of the roller shaft 41.

At this time, the arrangement position of the platen roller 42 in the housing 2 corresponds to the attachment position of the printing head 43 in the top cover unit 3. The roll TR stored by the user in the roll storage part 9 is set in the roll storage part 9 in the state where the print-receiving tape 7 is manually picked up to be pulled out from the roll TR in the feeding direction of the print-receiving tape 7 by the platen roller 42 (hereinafter, referred to as "tape feeding direction" as necessary). The print-receiving tape 7 is supported by and sandwiched between the printing head 43 disposed on the side of the top cover unit 3 and the platen roller 42 disposed on the side of the housing 2 by closing the top cover unit 3, to establish the state where printing by the printing head 43 can be performed. The gear fixed to the roller shaft 41 of the platen roller 42 engages with a gear train not shown on the side of the housing 2 by the closing of the top cover unit 3, for the platen roller 42 to be driven for its rotation by a feeding motor 44 that is a stepping motor. As a result, the platen roller 42 feeds out the print-receiving tape 7 from the roll TR stored in the roll storage part 9 and feeds the print-receiving tape 7 in the posture thereof for the tape width direction thereof to be the right-and-left direction.

The middle portion of the printing head 43 is journaled and the printing head 43 is urged downward by a proper spring member not shown. The printing head 43 is caused to be distant from the platen roller 42 by setting the top cover unit 3 to be opened by using the release tab 5. On the other hand, the printing head 43 pushes to urge the print-receiving tape 7 to the platen roller 42 using an urging force of the spring member for the printing head 43 to be able to print, by closing the top cover unit 3.

In this example, the roll TR has a configuration to have the print-receiving tape 7 wound in the roll such that the label base sheet 7B is on the outer side in the radial direction of the roll. As a result, the print-receiving tape 7 is fed out from the upper side of the roll TR in the state where the face thereof on the side of the label base sheet 7B faces upward (see a double-dotted chain line in FIG. 3), and the print is formed on the print-receiving parts 7Ba of the label base sheet 7B by the printing head 43 disposed on the upper side of the print-receiving tape 7. As a result, a print part 7Ba' (see FIGS. 7A-7B described later) that is the print-receiving part 7Ba already after its printing.

A separation plate 51 to peel off the print label L including the print part 7Ba' and the adhesive 7Bb from the separation material 7A by folding back the print-receiving tape 7 downward to be under the platen roller 42 when the print-receiving tape 7 is fed in a peeling-off feeding mode is disposed on the side in front of the platen roller 42. The print label L peeled off from the separation material 7A by the separation plate 51 is discharged to the exterior of the housing 2 through the first discharging exit 6A that is positioned on the side further ahead of the separation plate 51.

The cutting blade 8 is disposed on the side more downstream than the printing head 43 along the tape feeding direction and, when the print-receiving tape 7 is fed in the normal feeding mode described later, is used to cut off the print-receiving tape 7 that is discharged to the exterior of the housing 2 through the first discharging exit 6A in the state where the print label L and the separation material 7A are together with each other as one without being peeling off from each other by the separation plate 51, at a position desired by the user.

A pinch roller 61 that rotates driven by the rotation of the platen roller 42 is disposed under the platen roller 42. The pinch roller 61 feeds the separation material 7A folded back downward by the separation plate 51, by sandwiching the separation material 7A between the pinch roller 61 and the platen roller 42. The separation material 7A fed by the pinch roller 61 is discharged to the exterior of the housing 2 from the second discharging exit 6B. The pinch roller 61 is disposed on the opening and closing lid 6C through a proper support member not shown.

<Sensor>

A sensor arrangement portion 31 to be a recessed portion mounting face is disposed on the feeding path for the print-receiving tape 7 on the side in front of the roll storage part 9 (hereinafter, referred to as "tape feeding path" as necessary). A light emitting part 32 of a sensor 30 (see FIG. 4) to detect a predetermined reference position of the print-receiving tape 7 in a non-contact manner (optically detects in this example and may detect using another non-contact detection approach such as magnetic detection) is disposed on this sensor arrangement portion 31. In preparation for the case that plural types of print-receiving tape 7 having various types of width are used, the light emitting part 32 is arranged to be movable along the width direction of the print-receiving tape 7 (that is, the right-and-left direction) perpendicular to the tape feeding direction, in the sensor arrangement portion 31. The sensor 30 includes a known transmission optical sensor that includes the light emitting part 32 and a light receiving part 34 that is arranged on the lower face of the top cover unit 3. The light emitting part 32 and the light receiving part 34 face each other sandwiching the tape feeding path in the state where the upper face of the housing 2 is covered by the top cover unit 3. A transmitted light beam of the light beam emitted from the light emitting part 32 after being transmitted through the print-receiving tape 7 is received by the light receiving part 34 and, on the bases of the difference in the amount of the received light caused by, for example, the difference in the thickness between the label base sheet portion 70*a* and the inter-label base sheet portion 70*b* acquired as above, the sensor 30 detects each of the border positions each between the label base sheet 7B and the inter-label base sheet portion 70*b* (in other words, the positions of both end portions of each of the label base sheet 7B and the inter-label base sheet portion 70*b* in the tape feeding direction). As a result, a length LA (see FIGS. 5A-5B) of the label base sheet portion 70*a* along the tape feeding direction and a gap length LB (see FIGS. 5A-5B) of the inter-label base sheet portion 70*b* along the tape feeding direction are detected.

<Control System>

A control system of the label producing apparatus 1 will be described with reference to FIG. 6.

As shown in FIG. 6, the label producing apparatus 1 includes a CPU 71 that constitutes a computing part that performs predetermined computation. The CPU 71 performs signal processing in accordance with programs stored in advance in a ROM 73 using a temporary storage function of a RAM 72, and thereby performs control for the overall label producing apparatus 1. The CPU 71 is connected to the liquid crystal panel part 3B, the touch panel part 3A, the RAM 72, the ROM 73, the sensor 30, the power source button 4A, the status button 4B, the feed button 4C, the up button 4D, the down button 4E, a non-volatile memory 77, a motor drive circuit 74 that performs control for driving of the feeding motor 44 driving the platen roller 42, a printing head control circuit 75 that performs control for energization of heat generating elements of the printing head 43, and the like.

The CPU 71 is connected an external terminal 76 that includes a personal computer (PC) or the like to be able to transmit and receive information through wired or wireless communication. The CPU 71 receives desired print data that is produced and designated by operating the external terminal 76 by the user and a print command that includes the number of the print labels L to be produced, from the external terminal 76 to be input thereinto. The print command may be produced and input on the basis of an operation on the touch panel part 3A. The non-volatile memory 77 stores therein in advance parameter information of the plural types of print-receiving tape 7, that includes the length LA of the label base sheet portion 70*a* (hereinafter, referred to as "sheet length LA" as necessary and corresponding to a first length) and the gap length LB of the inter-label base sheet portion 70*b* (hereinafter, referred to as "gap length LB" as necessary and corresponding to a second length), as the parameters in relation to the outer shape of each of the plural types of print-receiving tape 7 (input from, for example, the external terminal 76) (see FIG. 8A described later).

The ROM 73 (that corresponds to a recording medium) stores therein various types of control program to perform a label production process (including a print process program that performs steps of flowcharts shown in FIG. 9 to FIG. 11 described later) and the like.

<Feeding Mode for Print-Receiving Tape>

With the label producing apparatus 1 configured as above, two types of feeding mode of a normal feeding mode and a peeling-off feeding mode are selectively realized as the feeding modes for the print-receiving tape 7.

<Normal Feeding Mode>

In the case that the print-receiving tape 7 is fed in the normal feeding mode, when the user stores the roll TR in the roll storage part 9 to set the roll TR therein, the user manually pulls out the print-receiving tape 7 from the stored roll TR and derives the print-receiving tape 7 to the position of the first discharging exit 6A without peeling off the print-receiving part 7Ba using the separation plate 51. In this state, the user closes the top cover unit 3 to complete the setting of the roll TR. After the completion of the setting of the roll TR as above, for the print-receiving tape 7 fed out from the roll TR by the rotation of the platen roller 42, formation of a print is performed by the printing head 43 on the print-receiving part 7Ba to form the print part 7Ba'. The print-receiving tape 7 is thereafter led as it is to the first discharging exit 6A without performing any peeling off by the separation plate 51 (in the state where the print label L and the separation material 7A are together with each other as one). In this case, the user cuts the print-receiving tape 7 discharged to the exterior of the housing 2 through the first discharging exit 6A, at a desired position using the cutting blade 8.

<Peeling-Off Feeding Mode>

In the case that the print-receiving tape 7 is fed in the peeling-off feeding mode, the user manually pulls out the print-receiving tape 7 from the stored roll TR to derive the print-receiving tape 7 to the position of the first discharging exit 6A. On the other hand, the user folds back the separation material 7A separated by being peeled off from the pulled out print-receiving tape 7, downward to be under the platen roller 42 through the separation plate 51 and derives the separation material 7A to the position of the second discharging exit 6B. The user thereafter closes the opening and closing lid 6C to cause the pinch roller 61 and the platen roller 42 disposed on the opening and closing lid 6 to support and sandwich therebetween the separation material 7A, and closes the top cover unit 3 to complete the setting of the roll TR. After the completion of the setting of the roll TR as above, in the same manner as above, for the print-receiving tape 7 fed out from the roll TR, formation of a print is performed on the print-receiving part 7Ba to form the print part 7Ba' and the peeling off of the print label L is performed by the separation plate 51. The separation material 7A from which the print label L is separated due to this peeling off is led to the second discharging exit 6B, and the peeled-off print label L is led to the first discharging exit 6A.

Background of Approach of this Embodiment

As to the label producing apparatus 1 of this embodiment, the plural types of print-receiving tape can be exchanged to be used as the print-receiving tape 7 (in other words, any proper one of the plural types can selectively be used) to perform the printing. The sensor 30 is therefore disposed to detect which type of the print-receiving tape 7 the one attached to the label producing apparatus 1 is, and, when the print-receiving tape 7 is fed, this sensor 30 detects the parameters in relation to the outer shape of the fed print-receiving tape 7 (in this example, the sheet length LA and the gap length LB) (see also FIG. 8B described later). The print formation operation performed by the printing head 43 is controlled corresponding to the result of the detection.

In the case that, as above, the printing is controlled on the basis of the result of the detection acquired when the feeding is performed, the detected values of the parameters are fluctuated due to a detection error of the sensor 30, disorder of the print-receiving tape 7 during its feeding, fluctuation of the mechanical resistance in the label producing apparatus 1, and the like and, as a result, the control mode of the print formation operation may be changed even with the same type of print-receiving tape 7.

The behavior in the case that the control mode is changed will be described with reference to FIG. 7A to FIG. 7C. For example, as shown in FIG. 7A, in the case that the values of the parameters are correctly detected and the normal printing is performed, a print part 7Ba' having a character string "ABCDE", a character string "FGHIJ", and a character string "KLNOP" arranged therein in three lines in the tape feeding direction is formed on the print-receiving part 7Ba of the label base sheet 7B by the printing head 43.

When the detected values of the parameters are fluctuated at this time, as shown in FIG. 7B, the case that the print is formed in the state where, for example, a lower portion of the character string "KLNOP" in the lowermost line of those for the character strings "ABCDE", "FGHIJ", and "KLNOP" in the third print part 7Ba' from the top in FIG. 7B runs off the edge of the print part 7Ba' (occurrence of what-is-called "cut-off character") may be present.

Otherwise, as shown in FIG. 7C, the case that, for example, in the second print part 7Ba' from the top in FIG. 7C, only the character strings "ABCDE" and "FGHIJ" of the character strings "ABCDE", "FGHIJ", and "KLNOP" to originally be printed are formed as a print and, in this state, the character string "KLNOP" following after the "FGHIJ" is formed as a print in the next third print part 7Ba' from the top in FIG. 7C that is, mistaken page feeding occurs may also be present. In this case, in the remaining portion of the third print part 7Ba', only the character string "ABCDE" of the character strings "ABCDE", "FGHIJ", and "KLNOP" to originally be printed is formed as a print and the character strings "FGHIJ" and "KLNOP" further following after the "ABCDE" are further formed as a print in the next fourth print part 7Ba' from the top in FIG. 7C.

Feature of Approach of this Embodiment

The feature of this embodiment lies in the fact that the above trouble is avoided and the print formation operation is stably controlled in the same mode only when the same type of print-receiving tape 7 is used (even assuming that the values of the parameters detected as above are somewhat fluctuated). The details thereof will be sequentially described below.

<Medium List>

In this embodiment, for example, for each of the plural types of print-receiving tape 7 whose use by the user is assumed in advance, the values of the parameters are stored in advance in the non-volatile memory 77 in the form of, for example, a medium list. An example of the medium list is shown in FIG. 8A.

In FIG. 8A, in this example, plural types of print-receiving tape 7 including mediums "A", "B", "C", "E", "F", "G", and so on are registered in advance. For example, the medium "A" has a width direction dimension in the direction perpendicular to the tape feeding direction (hereinafter, referred to simply as "width" as necessary) of 50.0 [mm], the sheet length LA of 85.0 [mm], and the gap length LB of 3.00 [mm]. As a result, the medium length L thereof that is the sum of the sheet length LA and the gap length LB (=LA+LB) is 88.0 [mm].

For example, the medium "B" has the width of 60.0 [mm] the sheet length LA of 92.0 [mm], the gap length LB of 3.20 [mm], and the medium length L of 95.2 [mm]. The medium "C" has the width of 80.0 [mm], the sheet length LA of 115.0 [mm], the gap length LB of 3.50 [mm], and the medium length L of 118.5 [mm]. The medium "D" has the width of 102.0 [mm], the sheet length LA of 50.0 [mm], the gap length LB of 2.80 [mm], and the medium length L of 52.8 [mm]. The medium "E" has the width of 102.0 [mm], the sheet length LA of 84.0 [mm], the gap length LB of 2.95 [mm], and the medium length L of 86.95 [mm]. The medium "F" has the width of 102.0 [mm], the sheet length LA of 102.0 [mm], the gap length LB of 3.10 [mm], and the medium length L of 105.1 [mm]. The medium "G" has the width of 102.0 [mm], the sheet length LA of 152.0 [mm], the gap length LB of 3.35 [mm], and the medium length L of 155.35 [mm].

The parameters are detected by the sensor 30 from one print-receiving tape 7 actually fed in the label producing apparatus 1 as above. In this example, an actual measurement of the sheet length LA (hereinafter, referred to simply as "sheet length LAr" as necessary) and an actual measurement of the gap length LB (hereinafter, referred to simply as "gap length LBr" as necessary) are detected. The CPU 71 compares the sheet length LAr and the gap length LBr as the detection results, and the length LA and the gap length LB of each of the plural types of print-receiving tape 7 recorded in advance in the medium list in FIG. 8A and thereby determines the type of the one print-receiving tape 7. In this example, especially, the CPU 71 identifies the medium length L whose value is the closest to the actual measurement of the medium length to be the sum of the sheet length LAr and the gap length LBr (hereinafter, referred to simply as "medium length Lr" as necessary), of the medium lengths L of the plural types of print-receiving tape 7 recorded in advance in the medium list in FIG. 8A and determines that the type of the one print-receiving tape 7 actually fed is the identified type of the print-receiving tape 7.

Example of Medium Type Determination Using Medium List

An example of the determination of the type of the print-receiving tape 7 (the medium type) using the above approach is shown in FIG. 8B.

For example, in the case of the print-receiving tape 7 whose detection number is "1", the sheet length LAr is 84.7 [mm], the gap length LBr is 3.20 [mm], and the medium length Lr is Lr=87.9 [mm]. When these values are compared to those in the medium list shown in FIG. 8A, it can be seen that the one having the closest value is the medium length L that is L=88.0 [mm] of the medium "A". As a result, the type of the print-receiving tape 7 of the detection number "1" is determined (identified) to be the medium A.

Similarly, in the case of the print-receiving tape 7 whose detection number is "2", the sheet length LAr is 85.4 [mm], the gap length LBr is 2.95 [mm], and the medium length Lr is Lr=88.35 [mm]. The medium presenting the medium length L of L=88.0 [mm] that is the closest value is the medium "A" and the type of the print-receiving tape 7 whose detection number is "2" is therefore determined to be the medium A.

Similarly, in the case of the print-receiving tape 7 whose detection number is "3", the sheet length LAr is 84.4 [mm], the gap length LBr is 3.20 [mm], and the medium length Lr is Lr=87.6 [mm]. The medium presenting the medium length L of L=88.0 [mm] that is the closest value is the medium "A" and the type of the print-receiving tape 7 whose detection number is "3" is therefore determined to be the medium A.

Similarly, in the case of the print-receiving tape 7 whose detection number is "4", the sheet length LAr is 114.7 [mm], the gap length LBr is 3.60 [mm], and the medium length Lr is Lr=118.3 [mm]. The medium presenting the medium length L of L=118.5 [mm] that is the closest value is the medium "C" and the type of the print-receiving tape 7 whose detection number is "4" is therefore determined to be the medium C.

Similarly, in the case of the print-receiving tape 7 whose detection number is "5", the sheet length LAr is 116.0 [mm], the gap length LBr is 3.45 [mm], and the medium length Lr is Lr=119.45 [mm]. The medium presenting the medium length L of L=118.5 [mm] that is the closest value is the medium "C" and the type of the print-receiving tape 7 whose detection number is "5" is therefore determined to be the medium "C".

Similarly, in the case of the print-receiving tape 7 whose detection number is "6", the sheet length LAr is 116.5 [mm], the gap length LBr is 3.55 [mm], and the medium length Lr is Lr=119.05 [mm]. The medium presenting the medium length L of L=118.5 [mm] that is the closest value is the medium "C" and the type of the print-receiving tape 7 whose detection number is "6" is therefore determined to be the medium C.

<Control Steps>

Control steps performed by the CPU 71 to realize the approach will be described next with reference to FIG. 9.

In FIG. 9, the process in this flowchart is started, for example, when the power source of the label producing apparatus 1 is turned on.

At step S10, the CPU 71 first determines whether or not the print command is input from the external terminal 76. The determination at step S10 is not satisfied (S10:NO) and the CPU 71 stands by in a loop until the CPU 71 determines that the print command is input. When the CPU 71 determines that the print command is input, the determination at step S10 is satisfied (S10:YES) and the CPU 71 moves to step S20.

At step S20, the CPU 71 outputs a control signal to the motor drive circuit 74 to drive the feeding motor 44. As a result, the platen roller 42 is driven and starts the feeding of the print-receiving tape 7. Prior to the print formation operation performed by the printing head 43 described later, the platen roller 42 is controlled to perform pre-printing feeding to perform the detection by the sensor 30. The process performed at this step S20 corresponds to a feeding control process described in the appended claims.

At step S30, the CPU 71 thereafter performs a detection process for the parameters (in this example, the sheet length LA and the gap length LB).

The details of the detection process at step S30 are shown in FIG. 10.

In FIG. 10, at step S110, the CPU 71 first determines whether or not a front end Ef of the label base sheet 7B (see FIG. 5B) is detected by the sensor 30. During the time period in which the front end Ef is not detected at step S110, the determination at step S110 is not satisfied (step S110:NO), the CPU 71 moves to step S170. At step S170, the CPU 71 determines whether or not a rear end Er of the label base sheet 7B (see FIG. 5B) is detected by the sensor 30. During the time period in which the rear end Er is not detected, the determination at step S170 is not satisfied (step S170:NO) and the CPU 71 returns to step S110 and repeats the same steps.

In the case that the front end Ef is detected in the time period in which the steps are repeated like steps S110 to step S170 to step S110 and so on as above, the determination at step S110 is satisfied (S110:YES) and the CPU 71 moves to step S120.

At step S120, the CPU 71 determines whether or not the rear end Er of the label base sheet 7B (see FIG. 5B) is detected by the sensor 30. In the case that the CPU 71 determines that the rear end Er is not detected, the determination at step S120 is not satisfied (step S120:NO) and the CPU 71 stands by in a loop. In the case that the CPU 71 determines that the rear end Er is detected, the determination at step S120 is satisfied (step S120:YES) and the CPU 71 moves to step S130.

At step S130, the CPU 71 determines the distance between the front end Ef and the rear end Er to be the sheet length LAr on the basis of the result of the detection of the front end Ef at step S110 and the result of the detection of the rear end Er at step S120.

At step S140, the CPU 71 thereafter determines whether or not the front end Ef of the label base sheet 7B with the number next to that of the label base sheet 7B for which the above front end Ef and the above rear end Er are detected is detected by the sensor 30. In the case that the CPU 71 determines that the front end Ef is not detected, the determination at step S140 is not satisfied (S140:NO) and the CPU 71 stands by in a loop. In the case that the CPU 71 determines that the front end Ef is detected, the determination at step S140 is satisfied (S140:YES) and the CPU 71 moves to step S150.

At step S150, on the basis of the result of the detection of the rear end Er at step S120 and the result of the detection of the front end Ef at step S140, the CPU 71 determines the distance between this rear end Er and this front end Ef to be the gap length LBr. The CPU 71 thereafter moves to step S160 described later.

On the other hand, in the case that the rear end Er is detected in the time period in which the steps are repeated like steps S110 to step S170 to step S110 and so on as above, the determination at step S170 is satisfied (S170:YES) and the CPU 71 moves to step S180.

At step S180, in the same manner as that at step S110, the CPU 71 determines whether or not the front end Ef of the label base sheet 7B is detected by the sensor 30. In the case that the CPU 71 determines that the front end Ef is not detected, the determination at step S180 is not satisfied (step S180:NO), the CPU 71 stands by in a loop. In the case that the CPU 71 determines that the front end Ef is detected, the determination at step S180 is satisfied (step S180:YES), the CPU 71 moves to step S190.

At step S190, in the same manner as that at step S150, on the basis of the result of the detection of the above rear end Er at step S170 and the result of the detection of the above front end Ef at step S180, the CPU 71 determines the distance between this rear end Er and this front end Ef to be the gap length LBr, At step S200, in the same manner as that at step S120, the CPU 71 thereafter determines whether or not the rear end Er of the label base sheet 7B is detected by the sensor 30. In the case that the CPU 71 determines that the rear end Er is not detected, the determination at step S200 is not satisfied (step S200:NO) and the CPU 71 stands by in a loop. In the case that the CPU 71 determines that the rear end Er is detected, the determination at step S200 is satisfied (step S200:YES) and the CPU 71 moves to step S210.

At step S210, in the same manner as that at step S130, on the basis of the result of the detection of the above front end Ef at step S180 and the result of the detection of the above rear end Er at step S200, the CPU 71 determines the distance between this front end Ef and this rear end Er to be the sheet length LAr. The CPU 71 thereafter moves to step S160 described later.

At step S160 moved to from step S150 (or step S210), on the basis of the sheet length LAr detected at step S130 (or step S210) and the gap length LBr detected at step S150 (or step S190), the CPU 71 calculates the sum Lr of these and causes this routine to come to an end to move to step S40 in FIG. 9. Step S30 described above corresponds to a detection step described in the appended claims.

Referring back to FIG. 9, at step S40, the CPU 71 performs the medium determination process using the approach described with reference to FIG. 8A and FIG. 8B. The details of the medium determination process performed at step S40 are shown in FIG. 11.

In FIG. 11, at step S310, the CPU 71 first reads the medium list in FIG. 8A stored in the non-volatile memory 77.

At step S320, the CPU 71 thereafter refers to the medium list read at step S310 and determines the type (the medium type) of the one print-receiving tape 7 having the medium length L with which a medium length difference ΔL between the medium length Lr and the medium length L of each of the types in the medium list (=|Lr−L|) that is calculated at step S160 becomes minimal. In the case that the plural types with which the medium length difference ΔL becomes minimal are present, no problem arises when one type of the plural types is determined using a proper approach determined in advance.

At step S330, the CPU 71 thereafter determines whether or not the medium length difference ΔL determined at step S320 is smaller than a predetermined threshold value determined in advance. When the CPU 71 determines that the medium length difference ΔL is equal to or larger than the threshold value, this determination is not satisfied (S330:NO) and the CPU 71 returns to FIG. 9 and causes the flow in FIG. 9 to come to an end. When the CPU 71 determines that the medium length difference ΔL is smaller than the threshold value, this determination is satisfied (S330:YES) and the CPU 71 causes this routine to come to an end and moves to step S50 in FIG. 9. Step S40 described above corresponds to a determination step described in the appended claims, and the process performed at step S40 corresponds to a determination process described in the appended claims.

Referring back to FIG. 9, at step S50, the CPU 71 determines whether or not the print-receiving tape 7 arrives at a printing starting position for the printing by the printing head 43 (in other words, whether or not the print-receiving tape 7 is fed to establish the state where the printing head 43 faces the position that corresponds to the front end position of the print area of the print-receiving part 7Ba of the label base sheet 7B in the tape feeding direction), using a known approach. The determination at step S50 is not satisfied before the print-receiving tape 7 arrives at the printing starting position (S50:NO) and the CPU 71 stands by in a loop. When the CPU 71 determines that the print-receiving tape 7 arrives at the printing starting position, the determination at step S50 is satisfied (S50:YES) and the CPU 71 moves to step S60.

At step S60, the CPU 71 outputs a control signal to the printing head control circuit 75 to control and energize the heat generating elements of the printing head 43 on the basis of the print data in the print command input at step S10. As a result, formation of the print that corresponds to the print data on the print-receiving part 7Ba of the label base sheet 7B is started.

At step S70, the CPU 71 thereafter determines whether or not the position of the print-receiving tape 7 in the tape feeding direction arrives at a printing ending position on the basis of the print data in the print command input at step S10, using a known approach. The determination at step S70 is not satisfied before the print-receiving tape 7 arrives at the printing ending position (S70:NO) and the CPU 71 returns to step S60 and repeats the same steps. When the CPU 71 determines that the print-receiving tape 7 arrives at the printing ending position, the determination at step S70 is satisfied (S70:YES) and the CPU 71 moves to step S80.

At step S80, the CPU 71 outputs a control signal to the printing head control circuit 75 to stop the energization of the heat generating elements of the printing head 43. As a result, the printing for the print-receiving part 7Ba on the label base sheet 7B is stopped.

At step S90, the CPU 71 thereafter determines whether or not the production of the total number of print label L that corresponds to the number of print label L to be produced in the print command input at step S10 is completed. In the case that the CPU 71 determines that the production of the total number of print label L is not completed, the determination at step S90 is not satisfied (S90:NO) and the CPU 71 returns to step S50 and repeats the same steps. In the case that the CPU 71 determines that the production of the total number of print label L is completed, the determination at step S90 is satisfied (S90:YES) and the CPU 71 moves to step S100.

At step S100, the CPU 71 outputs a control signal to the motor driving circuit 74 to stop the feeding of the print-receiving tape 7. The CPU 71 causes this flow to come to an end. Step S50 to step S100 correspond to a printing control step described in the appended claims, and the processes performed at step S50 to step S100 correspond to a printing control process described in the appended claims.

The present disclosure is not limited to the embodiment and various modifications can be made thereto within the scope not departing from the gist and the technical idea thereof. Such modification examples will sequentially be described below.

(1) Case that Detection Mark Arranged on Print-Receiving Tape is Detected

In the embodiment, the description has been made taking the example of the case that the print-receiving tape 7 having the label base sheets 7B consecutively arranged thereon at the specific intervals (that is a what-is-called die-cut label) is used and the inter-label base sheet portions 70*b* are detected by the sensor 30 while the print-receiving tape 7 is not limited to this. As shown in FIG. 12, the print-receiving tape 7 that includes a thermal layer and an image receiving layer and that has black marks BM (that each correspond to a detection mark) at a predetermined pitch disposed on the back face side thereof (for example, the separation material 7A) may be used. In this case, these black marks BM are each detected by the sensor and, thereby, the length LB of the black mark BM in the tape feeding direction (=the mark length and this corresponds to a third length) and the length LA in the tape feeding direction between the two black marks BM and BM adjacent to each other in the tape feeding direction (that is the sheet length in this case and that corresponds to a fourth length) are detected as the parameters. In this case, instead of the sensor 30, a reflection optical sensor that receives the reflected light beam reflected by the print-receiving tape 7 of a light beam emitted from a light emitting part, using its light receiving part may be used. The CPU 71 determines the type of one print-receiving tape 7 on the basis of a comparison between the sum (that corresponds to the medium length Lr) of an actual measurement of the mark length (that corresponds to the gap length LBr) and an actual measurement of the sheet length (that corresponds to the sheet length LAr) in relation to the one print-receiving tape 7 detected by the sensor 30, and the sum L (=LA+LB) of the mark length LB and the sheet length LA in relation to each of the plural types of print-receiving tape 7 stored in advance in the non-volatile memory 77 similar to the medium list shown in FIG. 8A. In this case, in the same manner as that at step S320 in FIG. 11, the type is determined such that the medium information indicating the deviation for these set to be minimal and indicating these each set to be smaller than a predetermined threshold value is established similar to step S330.

In this modification example, the influence of the detection error is alleviated compared to the case that the type of the print-receiving tape 7 is determined using only the sheet length or the mark length, by determining the type of the print-receiving tape 7 on the basis of the sum of the sheet length LA and the mark length LB (the medium length L) of each of the types of print-receiving tape 7 stored in advance and the sum of the sheet length and the mark length of the print-receiving tape 7 detected by the sensor 30 in the actual feeding.

(2) Others

The sensor is constituted by a transmission optical sensor or a reflection optical sensor in the above while a transmission optical sensor and a reflection optical sensor may concurrently be used.

In the case that description such as "perpendicular", "parallel", or "plane" is present in the above, this description has no strict meaning. These "perpendicular", "parallel", and "plane" respectively mean "substantially perpendicular", "substantially parallel", and "substantially plane" each allowing any tolerance and any error in relation to the design and the production.

In the case that description that the dimensions or the sizes in the outer appearance are "same", "equal", "different", or the like is present in the above description, this description has no strict meaning. These "same", "equal", and "different" respectively mean "substantially same", "substantially equal", and "substantially different" each allowing any tolerance and any error in relation to design and production. In the case, for example, that description of a value to be a predetermined determination criterion such as a threshold value or a reference value, or a value to be a delimiter is present, "same" "equal", and "different" for each of these values each however have a strict meaning different from the above case.

In the above, arrows shown in FIG. 6 indicate an example of the flows of the signals and do not limit the directions of the flows of the signals.

The flowcharts shown in FIG. 9, FIG. 10, and FIG. 11 do not limit the present disclosure to the steps shown therein, and any addition, any deletion, any chance of the order thereof, or the like may be made to the steps within the scope not departing from the gist and the technical idea of the present disclosure.

In addition to those described above, the approaches in accordance with the embodiment and the modification examples may properly be combined with each other to be used.

In addition, though not exemplified one by one, the present disclosure is implemented with various types of change made thereto within the scope not departing from the gist thereof.

What is claimed is:

1. A printer comprising:

a feeder configured to feed an elongated print-receiving medium to which a plurality of labels are bonded;

a printing head configured to form a plurality of print labels by sequentially forming desired prints on said plurality of labels of said print-receiving medium fed by said feeder;

a memory that stores, in advance, parameters in relation to an outer shape of each of plural types of the print-receiving medium;

a sensor configured to detect said parameters of said print-receiving medium fed by said feeder during said feeding; and a CPU, said CPU executing:

a determination process for determining a type of said print-receiving medium on the basis of a comparison between said parameters of said print-receiving medium detected by said sensor and said parameters of each of said plural types of print-receiving medium stored in said memory; and a printing control process for controlling a print formation operation of said printing head on said labels of said print-receiving medium fed by said feeder on the basis of a determination result in said determination process.

2. The printer according to claim 1, wherein said sensor is an optical sensor comprising a light emitting part configured to emit a light beam to said print-receiving medium and a light receiving part configured to receive said light beam.

3. The printer according to claim 1, wherein said plurality of labels are discretely disposed via a predetermined interval between each two of the labels on said print-receiving medium, and wherein said sensor is configured to detect, as said parameters:

a first length of each of said labels in a feeding direction by said feeder; and a second length of said interval in said feeding direction.

4. The printer according to claim 3, wherein in said determination process, the type of said print-receiving medium is determined on the basis of a comparison between a sum Lr of said first length and said second length in relation to said print-receiving medium detected by said sensor and a sum L of said first length and said second length in relation to each of said plural types of print-receiving medium stored in said memory.

5. The printer according to claim 4, wherein in said determination process, a type of said print-receiving medium with which a deviation $|Lr-L|$ is the smallest is identified from among said plural types of print-receiving medium stored in said memory and a type of said print-receiving medium detected by said sensor is determined as the type identified.

6. The printer according to claim 1, wherein said print-receiving medium includes a plurality of detection marks arranged thereon at positions that correspond to said plurality of labels, and wherein said sensor is configured to detect, as said parameters:

a third length of said detection mark along a feeding direction by said feeder; and a fourth length between two detection marks adjacent to each other in said direction of said feeding.

7. The printer according to claim 6, wherein in said determination process, the type of said print-receiving medium is determined on the basis of a comparison between a sum of said third length and said fourth length in relation to said print-receiving medium detected by said sensor and a sum of said third length and said fourth length in relation to each of said plural types of print-receiving medium stored in said memory.

8. The printer according to claim 7, wherein in said determination process, a type of said print-receiving medium with which a deviation between the sum of said third length and said fourth length in relation to said print-receiving medium detected by said sensor and the sum of said third length and said fourth length in relation to each of said plural types of the print-receiving medium stored in said memory is the smallest is identified and a type of said print-receiving medium detected by said sensor is determined as the type identified.

9. The printer according to claim 1, wherein said CPU further executes a feeding control process for controlling said feeder prior to a print formation operation by said printing head to perform a pre-printing feeding to perform detection by said sensor, and wherein said sensor is configured to detect said parameters of said print-receiving medium fed by said feeder on the basis of said feeding control process.

10. A non-transitory computer-readable recording medium capable of reading by a CPU included in a printer comprising a feeder configured to feed an elongated print-receiving medium to which a plurality of labels are bonded and has parameters in relation to an outer shape of said labels, a printing head configured to form a plurality of print labels by sequentially forming desired prints on said plurality of labels of said print-receiving medium fed by said feeder, and a memory that stores in advance said parameters of each of plural types of said print-receiving medium, the recording medium storing a printing process program for executing steps on said CPU, said steps comprising:

a detection step of detecting said parameters of said print-receiving medium fed by said feeder in said feeding;

a determination step for determining a type of said print-receiving medium on the basis of a comparison between said parameters of said print-receiving medium detected at said detection step and said parameters of said plural types of said print-receiving medium stored in said memory; and a printing control step for controlling a print formation operation of said printing head on said labels of said print-receiving medium fed by said feeder on the basis of a determination result in said determination step.

11. A printer comprising:

a feeder configured to feed an elongated print-receiving medium to which a plurality of labels are bonded;

a printing head configured to form a plurality of print labels by sequentially forming desired prints on said plurality of labels of said print-receiving medium fed by said feeder;

a sensor configured to detect parameters in relation to an outer shape of said print-receiving medium fed by said feeder during said feeding; and a CPU, said CPU executing:

a printing control process for controlling a print formation operation of said printing head on said labels of said print-receiving medium fed by said feeder on the basis of said parameters of said print-receiving medium detected by said sensor.

* * * * *